United States Patent [19]

Cherbourg et al.

[11] 4,177,605

[45] Dec. 11, 1979

[54] DEVICE FOR DRIVING PANELS IN CONVEYANCE, ESPECIALLY HORIZONTALLY-SLIDING WINDOWS IN AN AUTOMOBILE

[75] Inventors: Robert Cherbourg, Rueil Entree Rnur; Jean-Pierre Falluel, Pierrelaye Entree Rnur; Michel Ménard, Beynes Entree Rnur, all of France

[73] Assignee: Regie Nationale des Usines Renault, Boulogne-Billancourt, France

[21] Appl. No.: 880,177

[22] Filed: Feb. 22, 1978

[30] Foreign Application Priority Data

Feb. 22, 1977 [FR] France ..... 77 05013

[51] Int. Cl.[2] ..... E05C 7/06

[52] U.S. Cl. ..... 49/98; 49/136; 49/163; 49/352; 49/360

[58] Field of Search ..... 49/352, 102, 103, 123, 49/98, 136, 361, 360, 163, 168

[56] References Cited

U.S. PATENT DOCUMENTS

| | | | |
|---|---|---|---|
| 2,614,836 | 10/1952 | Williams | 49/98 |
| 2,792,917 | 5/1957 | Smith et al. | 49/18 X |
| 3,343,302 | 9/1967 | Browning et al. | 49/362 X |

*Primary Examiner*—Kenneth Downey

*Attorney, Agent, or Firm*—Oblon, Fisher, Spivak, McClelland & Maier

[57] ABSTRACT

A crank drives, by the intermediary of a system of cable and pulleys a carriage sliding on a fixed slide bar parallel to the displacement of sliding panels such as windows in an automobile so as to catch a latch and then drive in any direction the panels to be displaced, simultaneously or successively, the latch being part of a mobile slide bar serving as support independently for each of the panels and sliding with the carriage on the fixed slide bar.

7 Claims, 12 Drawing Figures

FIG. 1
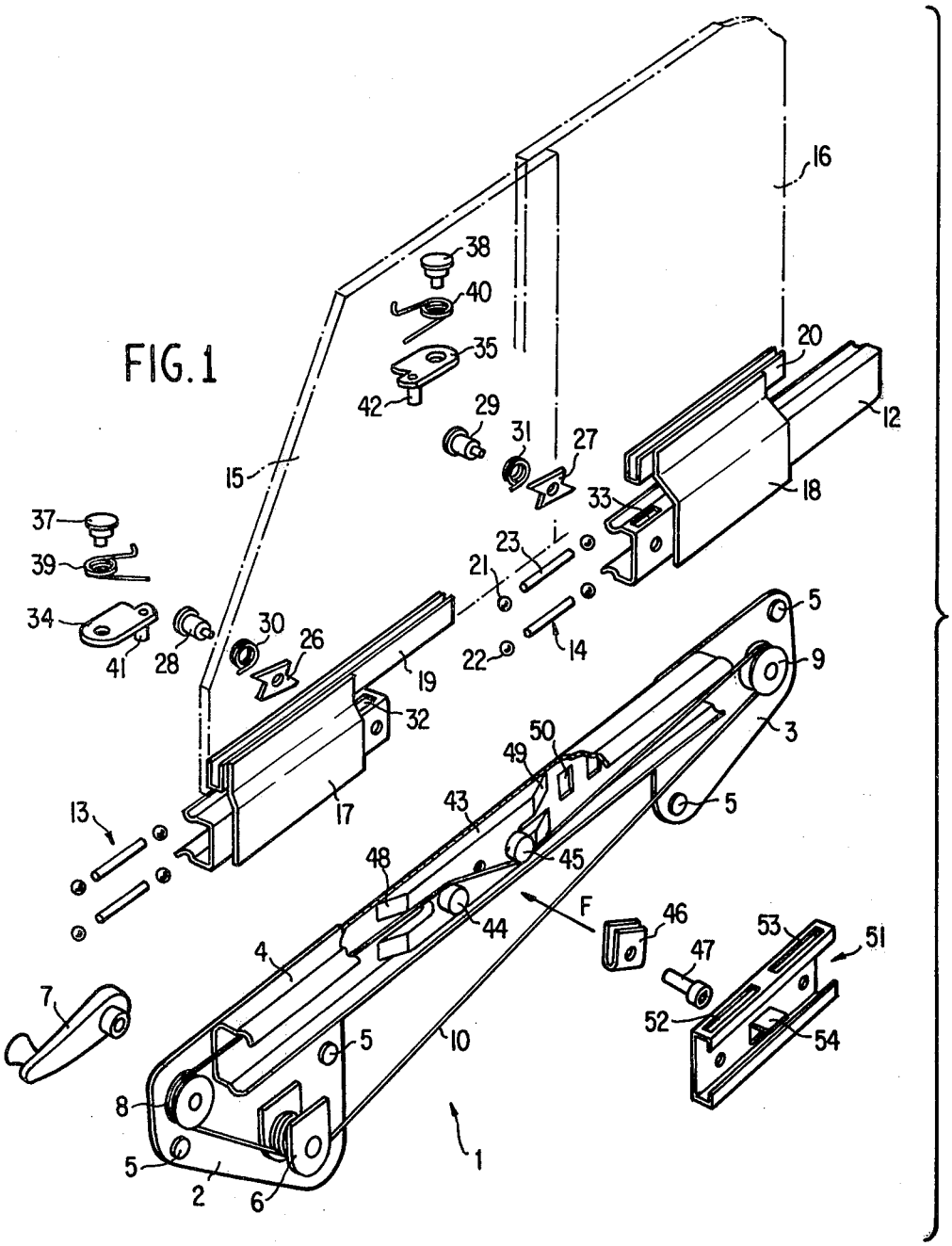
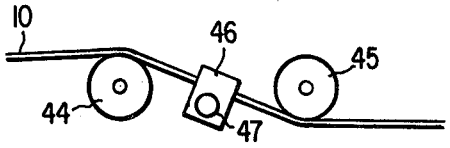
FIG. 2

DEVICE FOR DRIVING PANELS IN CONVEYANCE, ESPECIALLY HORIZONTALLY-SLIDING WINDOWS IN AN AUTOMOBILE

BACKGROUND OF THE INVENTION

The present invention relates to a mechanism for the relative and, if necessary, simultaneous driving of several mobile panels in conveyance on their plane and in particular to a device allowing displacement, simultaneous or not, in both directions of the sliding windows of an automobile, as well as their blockage at certain predetermined positions.

At present in the automobile the horizontally-sliding windows comprise one or two panes which may be displaced relatively in a simple or double slide-bar section, assuring both guidance and tightness of the windows on both faces and in cross section.

The maneuver of sliding a window is obtained by an operator pushing directly on the window itself or, more conveniently, by means of an interior button assuring also locking of the window in various positions. Furthermore, locking of the closed windows is practically obligatory to assure the inviolability of the vehicle from the outside. The locking of a window is thus achieved in relation to a door panel or in relation to the other window.

Users have acquired the habit of manipulating the windows of their vehicle by means of a crank placed on the inside door panel, vertically-descending windows being the most current type.

SUMMARY OF THE INVENTION

Accordingly, it is an object of the present invention to provide a device to mechanize the displacement of horizontally-sliding windows by transforming the rotation movement of a crank into a horizontal, rectilinear conveyance movement passed on to the sliding windows.

The objects of the invention are achieved by a driving device for sliding panels, characterized by the fact that it includes a crank which can drive a mobile carriage parallel to the displacement of the panels, a sliding carriage on a fixed slide bar so as to catch onto, by an appropriate part, a mobile slide bar serving as support independently to each of the panels and sliding with the carriage on the fixed slide bar so as to drive in any direction, simultaneously or successively, the panel or panels to be displaced.

According to a characteristic of the invention, the catching of the carriage onto each support slide bar is achieved by means of a pivoting latch around an axle carried by the support slide bar, a latch which engages in the aperture of a motor part fixed on the carriage and which can slide with it on the support slide bar until it catches.

Maneuvering the carriage in one direction or the other allows catching or unhooking each of the panels so as to drive it in the desired direction or so as to fix it in an intermediate position in which an attached locking mechanism permits blocking it.

One may understand the usefulness of such a device applied in particular to the sliding windows of an automobile so as to obtain various combinations for the ventilation of the interior.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein:

FIG. 1 shows in split perspective the ensemble of the device according to the invention, applied to the driving of two sliding windows.

FIG. 2 shows the fixation of the movement transmission cable on the carriage, following arrow F in FIG. 1.

DESCRIPTION OF THE PREFERRED EMBODIMENTS

Figure 3:
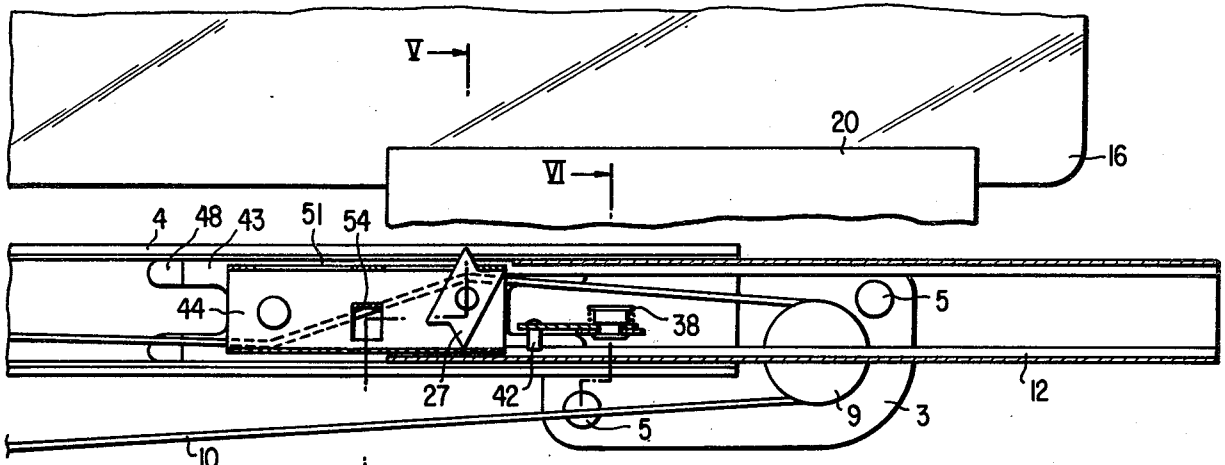
FIG. 3 and 4 show the plane and in elevation respectively an extremity of the assembled mechanism, engaged with a sliding window.

Referring now to the drawings, wherein like reference numerals designate identical or corresponding parts throughout the several views, and more particularly to FIG. 1 thereof, tthe driving device is assembled on a rigid plate 1 including two spaced flanges 2, 3 linked together by a soldered slide bar 4, made in a rectilinear sheet section. The flanges are mounted on the inside panel of a door case 58 (FIG. 4) by means of any mounting means, for example clips or screws 5.

The flanges 2, 3 also serve as support for a drum 6 with helicoidal rim driven by means of a crank 7 mounted on the inside plate of the door, and also for a set of two loose pulleys 8, 9 called return pulleys, defining a triangular circuit closed by a movement transmission cable 10.

The cable has both its ends blocked in the drum, which allows, in a well-known manner, regulation of the tension so as to assure that the mobile equipment can maneuver without any sliding.

The mechanism has just been described is thus that which transmits the movement of the operator and transforms the circular movement of the crank 7 into the rectilinear movement of the cable 10.

The fixed slide bar 4, joined onto the body, receives the complementary portions of two mobile slide bars 11, 12 configured to slide on the fixed slide bar by means of a series of bearings, repsectively 13, 14.

In this embodiment, the two small slide bars 11, 12 are shorter than the lengths of the sliding windows 15,, 16 each occpuying a half-window.

Each mobile slide bar supports a window by means of a base 17, 18 of an appropriate form, soldered below onto the mobile slide bar 11, 12 and above onto a window bottom 19, 20 fitting the window itself, with interposition of a tightness lining 58. (FIG. 5).

Figure 5:
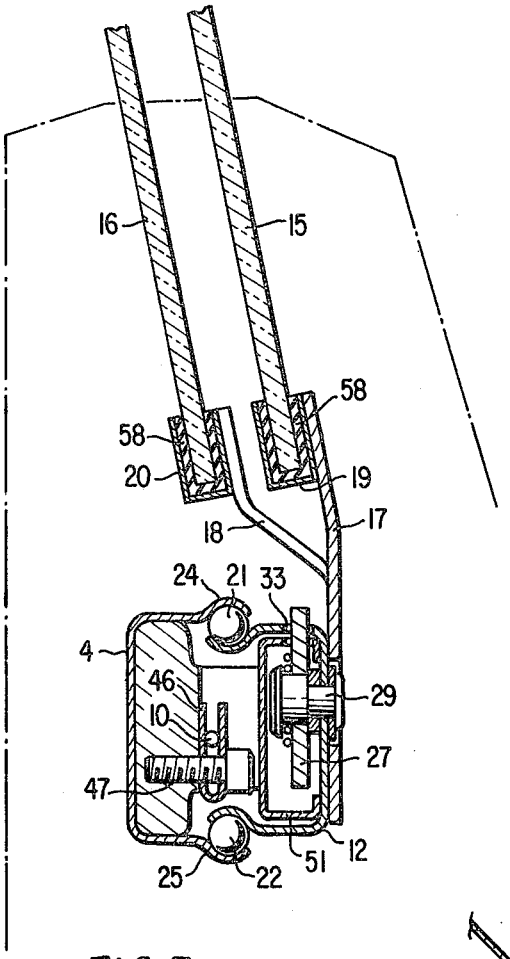
FIGS. 5 and 6 show in transversal cuts the driving and locking mechanisms respectively according to lines V and VI of FIG. 3, and FIGS. 7 to 12 illustrate the operation of the latch in view of the catching or unhooking of a window support by the mobile carriage.

So as to permit displacement of the panes along the window frame as well as their recovery intersection, the support slide bars 11, 12 are placed at the opposite ends of the windows 15, 16 in closed position (minimum recovery) while the bases 17, 18 are folded according to the different angles so as to reach the respective window bases 19, 20 horizontally displaced (FIG. 5).

Each series of bearings 13, 14 is formed of two upper bearings 21 and two lower bearings 22 separated two by two by a crossbar 23.

Figure 6:
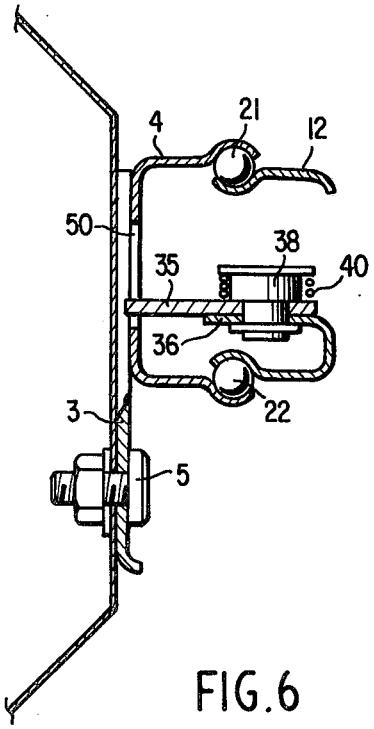

As may be seen more clearly in FIGS. 5 and 6, the rolling track for each series of bearings is formed by troughs made above 24 and below 25 in the section of the slide bars 4, 12 in complementary V's. The rolling of the bearings thus permits obtaining a very gentle sliding with an extremely weak friction coefficient, which improves the operation and yield of the mechanism.

Each small mobile slide bar 11, 12 window support is also furnished with a latch 26, 27 (FIGS. 3 and 5) hinged on one axis 28, 29 riveted onto the vertical wall of the slide bar 11, 12, the latch restrained elastically by a spiral spring 30, 31 to prevent untimely pivoting and which engages in an aperture 32, 33 made for this purpose in the slide bar 11, 12 along the hinged axis 28, 29.

The role of this latch will be explained further on. Finally, each support slide bar 11, 12 is equipped with a lock lever 34, 35 (FIGS. 4 and 6) hinged on one base 36 with a right-angled brace with the vertical wall of the slide bar 11, 12, the base combing from an opening in said wall. The hinged axis 37, 38 is clipped on the base while a torsion spring 39, 40, rolled around the axis, permanently constrains the lever 34, 35 against the vertical wall of the complementary fixed slide bar 4.

The end of the lever 34, 36 has a pin 41, 42 for unlocking; its operation may be uderstood after the following description of the mobile carriage 43, with reference to FIGS. 1 to 5.

The mobile carriage 43 is the motor element of the device. Long in form, it is adjusted to be guided to the slide inside the fixed slide bar 4. For this purpose, it is driven by the transmission cable 10 passing between two protuberances 44, 45 of the carriage to then roll around the two loose pulleys 8, 9 situated at the two ends of the fixed slide bar 4. The cable 10 is enclosed in a U-shaped clamp 46, itself attached to the carriage 43 by means of a screw 47.

Each end of the carriage ends in a ramp 48, 49 which can cooperate with the pins 41, 42 of the locking levers so as to free the latter from their engagement in the apertures 50 made in the vertical wall of the fixed slide bar 4.

The protuberances 44, 45 of the carriage permit fixation of another small U-shaped slide bar, called a motor slide bar 51, including both apertures 52, 53 in its upper horizontal wall and also a horizontal base 54 coming from a hole in the vertical wall.

As can be seen more clearly in FIG. 5, the motor slide bar 51 is of suitable dimensions so as to slide in one or another of the support slide bars 11, 12 without interfereing with the latch 277 or its hinged axis 29.

The upper aperture 52, 53 and 32, 33 of the motor slide bar and the support slide bar may coincide when the carriage 43 occupies a determined position in its course, so that the latch 26, 27 can be engaged and traverse the two apertures 32, 52 or 33, 53 simultaneously, which assures solidarity of the carriage with the window in question.

The distance between the upper apertures 52, 53 of the motor slide bar 51 is virtually the same as the width of the horizontal base 54 in front of the latter. Maneuvering the carriage 43 towards a latch 26, 27 thus allows bringing the base 54 of the motor slide bar into contact with the body of the latch without being hindered by the upper aperture 52, 53 so as to make the latch pivot around its axis 28, 29 and to bring it back below the level of said apertures to thus detach the carriage 43 from the window support slide bar 11, 12.

The device according to the invention operates in the following manner:

When the operator turns the crank 7 in one direction or the other, the movement is transmitted to the drum 6 which rolls up one segment of cable 10 while it unrolls tthe other. The carriage 43 being joined to the cable 10, the motor slide bar goes to meet the window support slide bar in question in the closen direction, for example, slide bar 12 of the inside window 16, shown in FIGS. 3 and 4.

Figure 4:
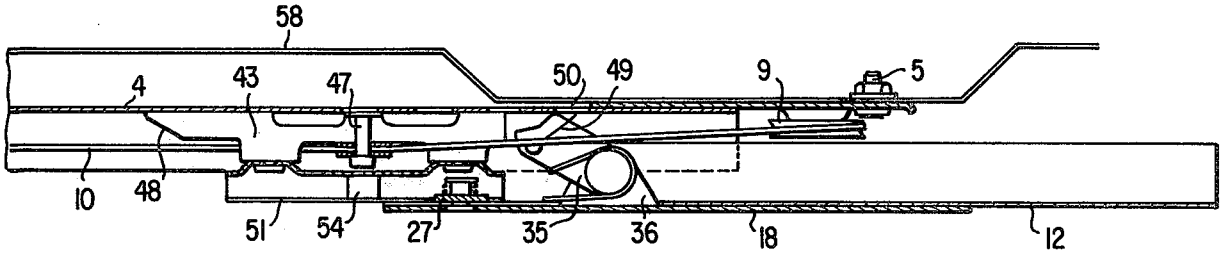

With its ramp 49, the first function of the carriage 43 is to cause withdrawal of the pin 42 and to free the lock lever 35 which was previously engaged in one of the apertures 50 of the fixed slide bar (FIG. 4). In this connection, the various apertures 50 along the slide bar permit blocking each sliding pane in any position and preventing its moving both from inside and outside the vehicle, other than with the mechanism described. This system thus insures the inviolability of the vehicle.

The support slide bar 12 is thus unlocked; the carriage and its motor slide bar 51 continue their course and come to meet the latch 27 attached to the support slide bar 12.

The base 54, attached to the motor slide bar 51, causes the latch 27 to pivot (the latch was previously in a basically horizontal position) until the latter comes to buttress the upper aperture 53 of the motor slide bar 51 so as to finally traverse it.

The attachment of the carriage 43 and the support slide bar being achieved, the cable 10 can direct the window in the appropriate direction.

Hooking and unhooking a window imply a series of manuevers essentially linked to the operation of the latch 26, 27. The latter is presented in the form of a small, flat, rectangular part whose small sides are trimmed to reentry and opposing V's 55, 56 (FIG. 7).

FIGS. 7 to 12 illustrate its particular operation, under the alternate stress of the base 54 and the sides of the upper aperture 53 of the motor slide bar, forming active lugs.

Figure 7:
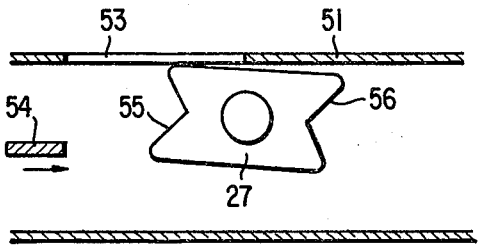
Figure 8:
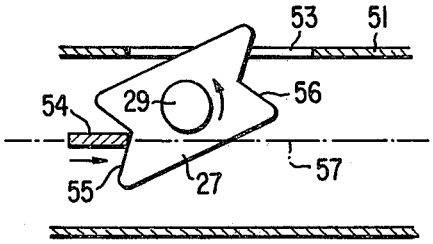

FIGS. 7 and 8 refer to the transfer of the carriage 43 and the motor slide bar 51 so as to hook a window (via latch 27) found in any position.

In FIG. 7, the carriage is displaced towards the right, the base 54 coming to meet the fixed latch 27 kept in this orientation by its spiral spring 31.

In FIG. 8, the base 54 enters into contact with the V-form of the latch 55. The rectilinear trajectory 57 of the base passing under the rotation axis 29 of the latch, the latter pivots under the action of the couple created in buttressing against the base 54, while the other end 56 of the latch engages in the upper aperture of the motor slide bar.

Figure 9:
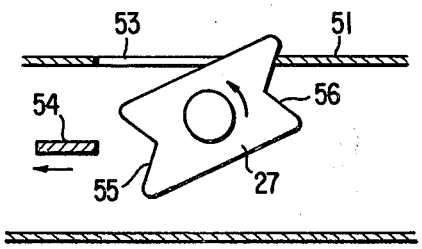
Figure 10:
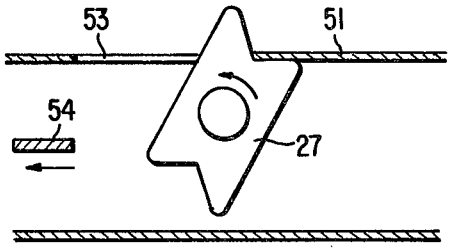

FIGS. 9 and 10 refer to driving the hooked window, after inversion of the rotation direction of the crank and thus displacement of the carriage. In FIG. 9, the base 54 disengages from the latch 27 while the right side of the aperture 53 of the motor slide bar comes to strike against the opposite V 56 of the latch, causing it to pursue its pivoting until reaching the blocking position shown in FIG. 10. The carriage 43, pursuing its course in the same direction, drives the window 16 by the attachment of the motor slide bar 51 and support slide bar 12.

When the window reaches the desired position, the rotation direction of the crank must be reversed so as to unhook the carriage and free the latch.

Figure 11:
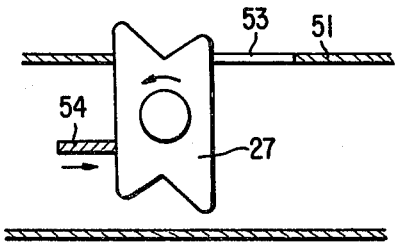
Figure 12:
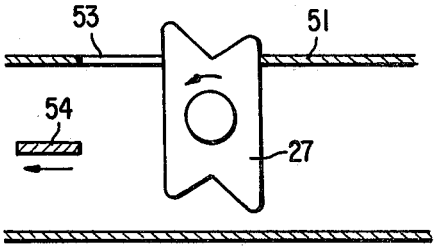

As in FIG. 11, the base 54 comes to strike against the one shown with parallel faces to the latch and causes it to pivot always in the same direction so as to bring it into a vertical position where it freely traverses the upper aperture 53. By again reversing the rotation direction of the crank, FIG. 12, the right side of the aperture 53 brings the latch 27 back into the transfer position in FIG. 7. At that moment, the motor 51 and window support slide bars 12 are detached, which allows the carriage 43 to go to hook the other window 15 by a series of symmetrical manipulations.

Once the carriage leaves a support slide bar 11, 12, the corresponding ramp 48, 49 ceases its activity on the pin of the lock lever 34, 35 which assures its engagement in a window 51 of the fixed slide bar and thus the locking of the window in the desired position.

One thus sees that the windows 15, 16 can be maneuvered one after the other in both directions. The device according to the invention also allows the following maneuver:

When a window is driven by the cable-carriage slide bar driving mechanism, the slide bar may strike against the support slide bar of the other window, located in the extension of the first, and push it. The two windows 15, 16 are then activated simultaneously in the same direction.

The invention is not limitted too the embodiment described. In the same spirit, one may reverse the relative positions of the base of the slide bar and the latch without changing the operation of the device.

Without modifying the scope of the invention, one could replace the ball-bearing slide bars with slide bars with mobile rollers or friction shoe slide bars. In the same way, it is possible to utilize a flat or serrated belt to replace the transmission cable, with corresponding adaptation of the driving drum.

It goes without saying that the device according to the invention could find many applications in driving sliding panels in some other domain than that of the automobile.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for driving sliding panels in a plane comprising:

a pair of movable panels;

a fixed slide bar;

a carriage slidably disposed on the fixed slide bar;

a motor slide bar connected to the carriage and capable of sliding with the carriage on the slide bar;

a pair of supporrt slide bars slidably disposed on the fixed slide bar, each support bar having a latch selectively engageable by said motor slide bar and independently supporting one of the panels for back and forth movement; and crank means for driving the carriage to cause engagement of the motor slide bar with a latch of one of the support slide bars to drive the panel supported by the one of the support slide bars.

2. The device recited in claim 1, wherein each latch is pivotable around an axle carried by the respective support slide bar and the motor slide bar has an aperture for engaging a latch.

3. The device recited in claim 2, wherein opposite faces of the latches are V-shaped and the motor slide bar has a base capable of striking a V-shaped face of a latch to cause the latch to pivot and engage the aperture of the motor slide bar.

4. The device recited in claim 1, wherein the fixed slide bar has a plurality of apertures, and including a pivotable lever carried by at least one of the support slide bars for elastically constraining the fixed slide bar to allow locking the one of the support slide bars in one of the plurality of apertures of the fixed slide bar.

5. The device recited in claim 4, wherein the carriage has a ramp at either end thereof for retracting the lever during locking of the support slide bar causing withdrawal of a pin attached to the lever.

6. The device recited in claim 1 including an upper and a lower set of bearings for supporting each support slide bar while the support slide bar slides on the fixed slide bar, a crossbar separating the upper and lower set of bearings, and wherein the support slide bars have channels made in their profiles forming rolling tracks for the bearings.

7. The device recited in claim 1 wherein the crank means includes:

a pair of pulleys disposed on the fixed slide bar;

a drum, a movement transmission cable wrapped around the pair of pulleys and the drum and engaging the carriage; and a crank connected to the drum for driving the drum.

* * * * *